US006757510B2

(12) United States Patent
Terai

(10) Patent No.: US 6,757,510 B2
(45) Date of Patent: Jun. 29, 2004

(54) DEVELOPING DEVICE AND IMAGE FORMING APPARATUS USING THE SAME

(75) Inventor: Junichi Terai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 108 days.

(21) Appl. No.: 10/075,462

(22) Filed: Feb. 15, 2002

(65) Prior Publication Data

US 2002/0141789 A1 Oct. 3, 2002

(30) Foreign Application Priority Data

Feb. 16, 2001 (JP) ..... 2001-040318
Mar. 23, 2001 (JP) ..... 2001-085969

(51) Int. Cl.[7] ..... G03G 15/09
(52) U.S. Cl. ..... 399/267; 399/277
(58) Field of Search ..... 399/267, 274, 399/275, 276, 277

(56) References Cited

U.S. PATENT DOCUMENTS 5,296,328 A * 3/1994 Fuji et al. ..... 399/267 X
5,576,812 A * 11/1996 Hibino et al. ..... 399/267
5,754,929 A * 5/1998 Nonomura et al. ..... 399/275
6,219,514 B1 * 4/2001 Kobayashi et al. ..... 399/277
6,337,957 B1 1/2002 Tamaki et al. ..... 399/29
6,385,423 B1 * 5/2002 Kai ..... 399/277
6,442,364 B2 * 8/2002 Kai et al. ..... 399/277
6,449,452 B1 * 9/2002 Kai ..... 399/267
6,597,885 B2 * 7/2003 Kai et al. ..... 399/277

FOREIGN PATENT DOCUMENTS

JP 63-197977 8/1988
JP 2000-347506 12/2000

* cited by examiner

*Primary Examiner*—Fred L. Braun
(74) *Attorney, Agent, or Firm*—Oblon, Spivak, McClelland, Maier & Neustadt, P.C.

(57) ABSTRACT

In an image forming apparatus, a magnet brush forming device includes at least a first magnetic pole facing an image carrier carrying a latent image and a second magnetic pole positioned downstream of the first magnetic pole in the direction of rotation of a developer carrier. When a magnet brush formed on a developer carrier by the first magnetic pole forms a nip between it and the image carrier, flux density in the direction normal to the developer carrier has an attenuation ratio of 40% or above. The second magnetic pole has an upstream half-value point located downstream of a point upstream of and angularly spaced from the edge of a developer storing member by 15°. Flux density in the normal direction and flux density in the tangential direction between the first and second magnetic poles have vectors the sum of which is 85 mT or above.

18 Claims, 14 Drawing Sheets

3a
B
A
Y

3a
A
Y

3a
A
C
Y

DEVELOPING DEVICE AND IMAGE FORMING APPARATUS USING THE SAME

BACKGROUND OF THE INVENTION

1. Field of the Invention

The present invention relates to a copier, facsimile apparatus, printer, direct digital master making machine or similar electrophotographic image forming apparatus. More particularly, the present invention relates to a developing device of the type developing a latent image with a magnet brush and an image forming apparatus using the same.

2. Description of the Background Art

Generally, an electrophotographic image forming apparatus includes an image carrier implemented as a photoconductive drum or a photoconductive belt. A developing device develops a latent image formed on the image carrier to thereby produce a corresponding toner image. It is a common practice with this type of image forming apparatus to use either one of a one-ingredient type developer or toner and a two-ingredient type developer, i.e., a mixture of toner and carrier grains. Development using the two-ingredient type developer features desirable image transferability and desirable developing characteristics against temperature and humidity. The two-ingredient type developer forms brush chains on a developer carrier in a developing zone where the developer carrier faces the image carrier. The toner is fed from the developer on the developer carrier to a latent image formed on the image carrier.

As for the development using the two-ingredient type developer, a decrease in the distance between the image carrier and the developer carrier in the developing zone allows high image density to be easily attained and reduces so-called edge effect. This, however, is apt to cause the trailing edge of a black solid image or that of a halftone solid image to be lost. Let this undesirable phenomenon be referred to as the omission of a trailing edge hereinafter.

The omission of a trailing edge can be reduced if a nip where the magnet brush contacts the surface of the image carrier is reduced in width in the direction of movement of the above surface, as reported in the past. The omission of a tailing edge can be further reduced if the magnet brush is dense at the nip, as also reported in the past.

On the other hand, there is an increasing demand for a high-speed developing device that enhances productivity. A high-speed developing device, however, brings about a problem that the developer scatters or drops. More specifically, assume that the developing device includes a main magnetic pole for causing the developer to rise in the form of a magnet brush and auxiliary magnetic poles respectively positioned upstream and downstream of the main pole in the direction of movement of the developer carrier. The auxiliary poles are opposite in polarity to the main pole and play the role of means for promoting the turn-round of the magnetic lines of force issuing from the main pole. In this configuration, the developer scatters away from the downstream auxiliary pole.

Higher image quality is another target to tackle at the same time as the obviation of the omission of a trailing edge. More specifically, faithful reproduction of thin lines and small dots and reproduction of uniform halftone images with a minimum of granularity are essential with the image forming apparatus. As for the development using the two-ingredient type developer, it has been reported that reducing the grain size of toner and carrier grains is successful to increase resolution and therefore to enhance image quality. However, if the volume mean grain size of carrier grains is 65 $\mu$m or below, then the carrier grains are apt to deposit on the image carrier and, in the worst case, cause an image to be lost. This will be referred to as carrier deposition hereinafter. A decrease in the saturation magnetization ratio of the carrier is expected to make the magnet brush dense and soft enough to form an image free from directionality. However, a saturation magnetization ratio of 80 emu/g or below brings about carrier deposition.

More specifically, the carrier grains deposited on the image carrier produce air gaps between the image carrier and a sheet or recording medium, weakening an electric field around the grains. As a result, image portions around the carrier grains are not sufficiently transferred from the image carrier to the sheet and are therefore lost. Further, if such carrier grains are transferred from the image carrier to the sheet, then even the toner grains around the carrier grains are not fixed on the sheet, resulting in defective fixation. The unfixed image would be lost if rubbed off and would contaminate the sheet. Moreover, the carrier grains unfixed on the sheet are apt to move during fixation and cause other image portions to be lost. Conversely, if the carrier grains are left on the image carrier without being transferred to the sheet, then they are apt to scratch the image carrier when removed by a cleaner and cause an image to be partly lost. In addition, when the carrier grains are consumed little by little due to carrier deposition, it is likely that the total amount of the developer and therefore image density becomes short.

The toner and carrier forming a two-ingredient type developer are charged to opposite polarities. For example, when the toner is charged to positive polarity, the carrier is charged to negative polarity. The carrier is therefore apt to deposit on the non-image portion of the image carrier when the toner deposits on the image portion of the same. This carrier deposition is dependent on a potential difference between the non-image portion and the developer carrier. Specifically, even the toner deposits on the non-image portion when the potential difference is small, contaminating the background of the image carrier. The carrier does not deposit on the non-image portion when the potential difference is great.

To obviate carrier deposition, it is necessary to intensity magnetic attraction attracting the carrier present on the developer carrier in the developing zone. Experiments showed that carrier deposition occurred at the downstream end of the nip, i.e., the moment when the developer on the developer carrier left the developing zone. Therefore, the prerequisite is that the auxiliary pole or second pole downstream of the main pole has its magnetic attraction intensified on the image carrier (not on the developer carrier).

Technologies relating to the present invention are disclosed in, e.g., Japanese Patent Laid-Open Publication No. 2000-347506 and Japanese Patent No. 2,517,579.

SUMMARY OF THE INVENTION

It is a first object of the present invention to provide a developing device capable of reducing defects including the omission of a trailing edge and preventing a developer from dropping due to a centrifugal force in the event of high-speed development, and an image forming apparatus using the same.

It is a second object of the present invention to provide a developing device capable of reducing the above defects and obviating, even when a carrier with a small grain size is used, carrier deposition to thereby realize faithful reproduction of thin lines and small dots and reproduction of uniform halftone images with a minimum of granularity.

A developing device of the present invention includes a developer carrier, a magnet brush forming device for causing a developer to rise on the developer carrier in the form of a magnet brush with a magnetic pole, and a developer storing member for storing the developer developed a latent image. The magnet brush forming device includes at least a first magnetic pole facing an image carrier carrying the latent image, which is to be developed by the magnet brush, and a second magnetic pole positioned downstream of the first magnetic pole in the direction of rotation of the developer carrier. When the magnet brush formed by the first magnetic pole forms a nip between the magnet brush and the image carrier, flux density in the direction normal to the developer carrier has an attenuation ratio of 40% or above. The second magnetic pole has an upstream half-value point located downstream of a point upstream of and angularly spaced from the edge of said developer storing member by 15°.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
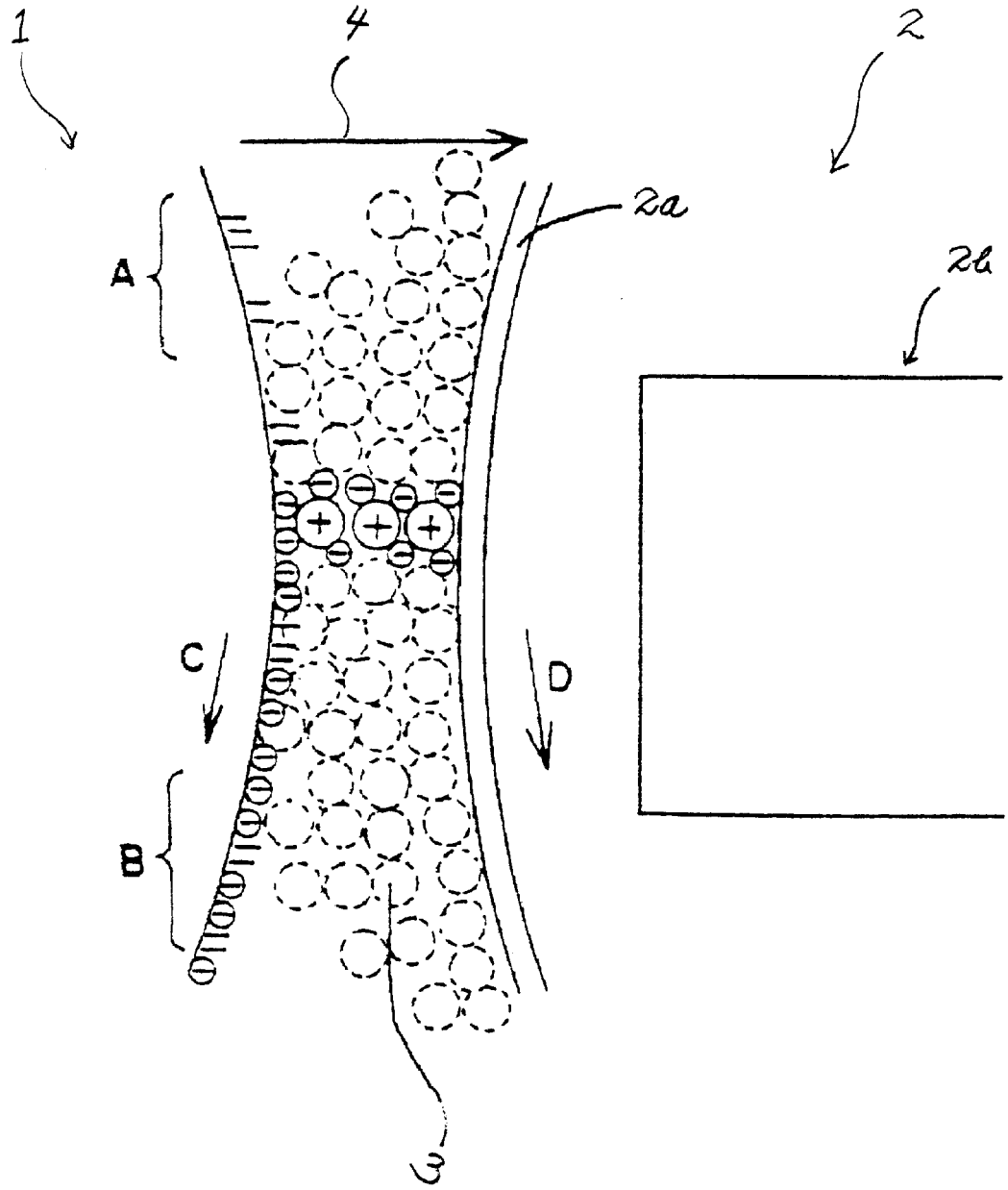
FIG. 1 is a view showing a developing device of the type effecting negative-to-positive development by way of example.

To better understand the present invention, the omission of the trailing edge of an image will be described more specifically with reference to FIG. 1. FIG. 1 shows a developing section for executing negative-to-positive development with a two-ingredient type developer. As shown, a photoconductive drum or image carrier 1 and a developing roller or developer carrier 2 face each other. The developing roller 2 is made up of a sleeve 2*a* movable in a direction D and a magnet 2*b* fixed in place in the sleeve 2*a*. The magnet 2*b* forms a magnetic pole for development. The sleeve 2*a* conveys the developer, i.e., toner and carrier mixture deposited thereon toward a developing zone where the sleeve 2*a* faces the drum 1.

The carrier rises on the sleeve 2*a* in the form of brush chains in the developing zone, forming a magnet brush 3. In FIG. 1, small circles and large circles are representative of toner grains and carrier grains, respectively. Only one of the brush chains intervening between the drum 1 and the sleeve 2*a* is indicated by solid circles; the other brush chains are indicated by phantom circles, and toner grains are not shown.

The drum 1 rotates in a direction C while carrying a latent image thereon. Assume that the non-image portion of the drum 1 has been changed to negative polarity, as represented by a range A in FIG. 1. In the developing zone, the magnet brush 3 rubs itself against the latent image with the result that the toner grains deposit on the latent image due to an electric field 4 for development. Consequently, a toner image is formed on the drum 1 at the downstream side of the developing zone, as indicated by range B.

The width over which the magnet brush 3 contacts the surface of the drum 1 in the direction of movement of the drum 1 will be referred to as a nip width hereinafter. If only one point of the sleeve 2*a* contacts one point of the drum 1, then sufficient image density is not available. It is therefore a common practice to cause each of the drum 1 and sleeve 2*a* to move at a particular linear velocity, so that the sleeve 2*a* can contact one point of the drum 1 over a certain range thereof. In FIG. 1, the sleeve 2*a* is assumed to move at a higher linear velocity than the drum 1.

Figures 2A, 2B, 2C:
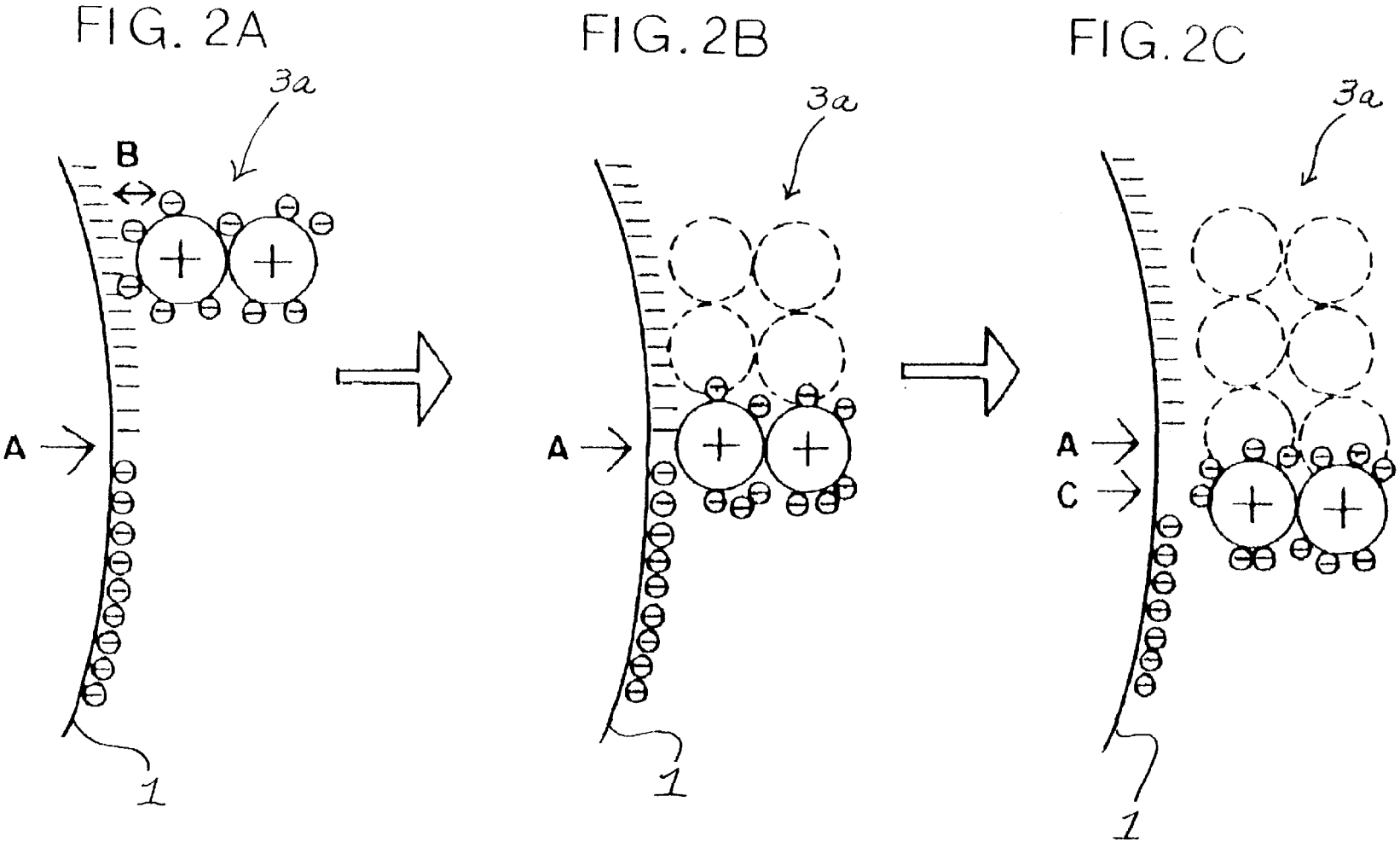
FIGS. 2A through 2C demonstrate how the trailing edge of an image is lost.

The mechanism that causes the trailing edge of an image to be lost will be described hereinafter. FIGS. 2A through 2C are enlarged views of the developing zone and show the tip 3*a* of the brush chain 3 sequentially approaching the drum 1; time expires in the order of FIGS. 2A, 2B and 2C. In FIGS. 2A through 2C, the boundary between the non-image portion and the black, solid image portion of the drum 1 is being developed at the position where the drum 1 and sleeve 2*a*, not shown, face each other. In this condition, the omission of a trailing edge is apt to occur. A toner image just formed is present on the drum 1 at the downstream side of the above position in the direction of rotation of the drum 1. The tip 3*a* of the brush chain approaches the drum 1 in such a condition. While the drum 1 is, in practice, rotating clockwise, as viewed in FIGS. 2A through 2B, the tip 3*a* passes the drum 1 because the sleeve 2*a* is moving at a higher linear velocity than the drum 1. For this reason, the drum 1 is assumed to be stationary in FIGS. 2A through 2C for simplicity.

As shown in FIG. 2A, the tip 3*a* of the brush chain approaching the drum 1 passes the non-image portion before it reaches a position A where the boundary mentioned above is positioned. At this instant, repulsion B acts between the negative charge deposited on the drum 1 and the negative charge deposited on the toner grains, causing the toner grains to move away from the drum 1 toward the sleeve 2*a* little by little. This phenomenon is generally referred to as toner drift. As a result, as shown in FIG. 2B, when the tip 3*a* arrives at the position A, the carrier grain charged to positive polarity is exposed to the outside without any toner grain depositing on the latent image. The latent image is therefore not developed at the above position at all.

As shown in FIG. 2C, when the tip 3*a* reaches a position C, toner grains present on the drum 1 are apt to again deposit on the carrier grains of the tip 3*a* if adhesion acting between the above toner grains and the drum 1 is weak. This is why the trailing edge of the toner image is lost.

Figure 3A:
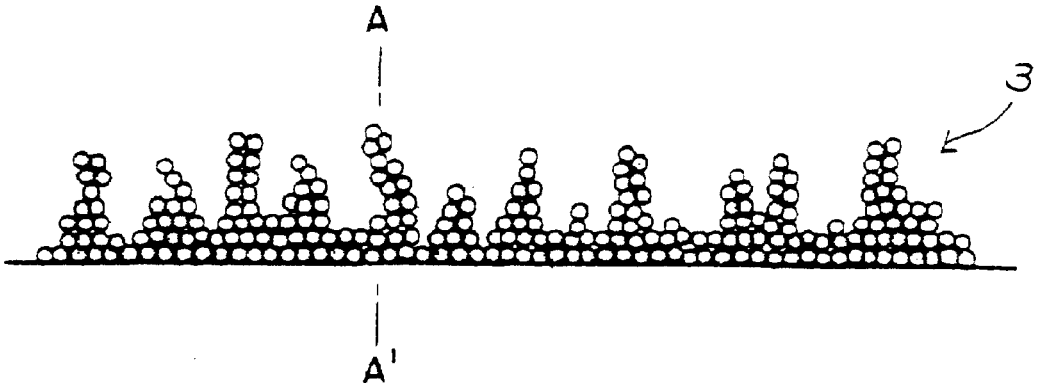
FIG. 3A is a sketch showing a magnet brush whose brush chains are different in height in the axial direction of a developing roller.
Figure 3B:
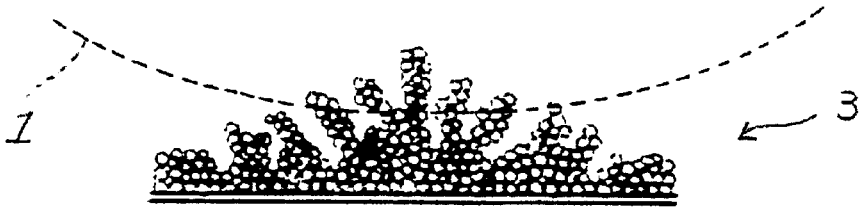
FIG. 3B is a section showing the magnet brush of FIG. 3A in a plane perpendicular to the axis of the developing roller.

The mechanism described above has concentrated on a single section of the developing zone where the drum 1 and sleeve 2*a* face each other. The brush chains of the magnet brush 3 differ in length, or height, as viewed in the axial direction of the sleeve 2*a*. Specifically, FIG. 3A shows the magnet brush 3 in the axial direction of the sleeve 2*a* while FIG. 3B shows it in a section along line A–A' of FIG. 3*a*. FIG. 3B shows the positional relation between the magnet brush 3 and the drum 1 in order to indicate the relation between FIG. 3B and the other figures.

Figure 4A:
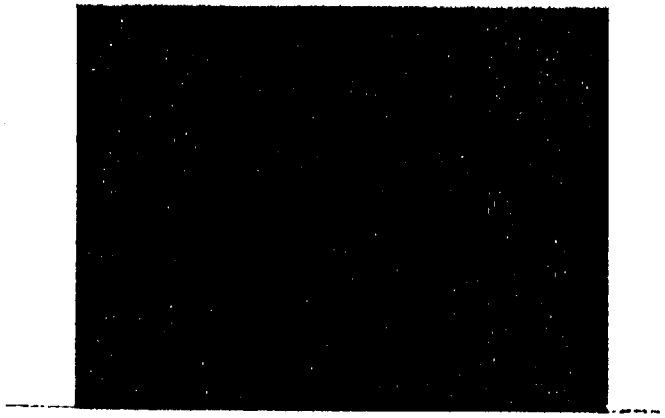
FIGS. 4A through 4D show a relation between the omission of a trailing edge and the density of a magnet brush.
Figure 4B:
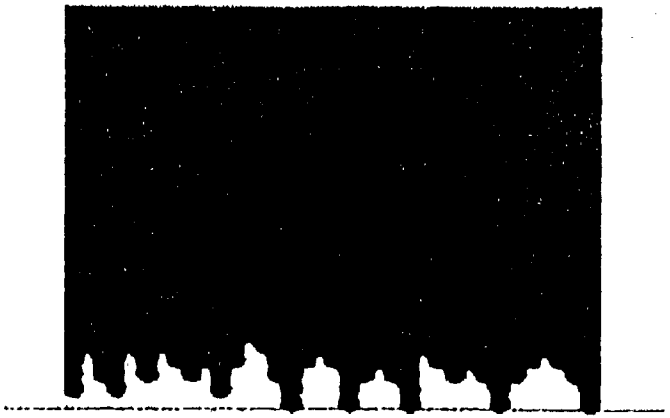

As shown in FIG. 3A, the brush chains of the magnet brush 3 noticeably differ in height in the axial direction of the sleeve 2*a* and therefore do not contact the drum 1 at the same level in the above direction. The degree of toner drift therefore differs from one brush chain to another brush chain in the axial direction of the sleeve 2*a*. This brings about the omission of a trailing edge that is jagged in the axial direction of the sleeve 2*a*, as shown in FIG. 4B. Further, the mechanism described above reduces the width of a thin horizontal line, compared to that of a thin vertical line, and makes the shape of a solitary dot unstable.

The omission of a trailing edge can be reduced if the nip width is reduced or if a dense magnet brush is formed at the nip, as stated earlier. Presumably, by reducing the nip width in the developing zone, it is possible to reduce the period of time over which the magnet brush 3 contacts the non-image portion of the drum 1 and therefore to reduce toner drift. This will be described more specifically with reference to FIGS. 5A through 5C.

Figures 5A, 5B, 5C:
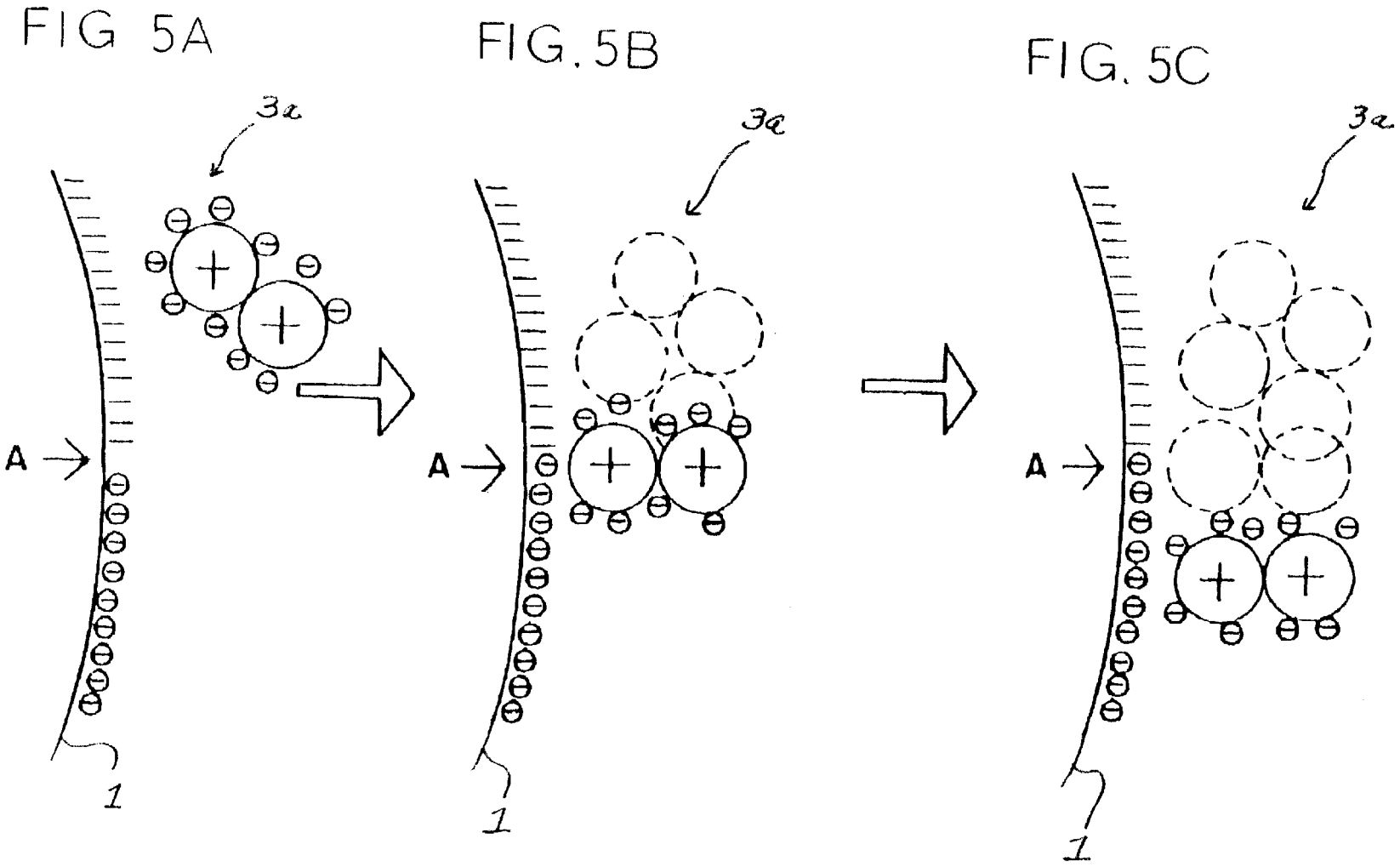
FIGS. 5A through 5C show how toner drift at a nip for development is reduced.

FIGS. 5A through 5C are views similar to FIGS. 2A through 2C except that the nip width is reduced. As shown in FIG. 5A, the period of time over which the tip 3*a* of the magnet brush contacts the drum 1 is reduced, reducing toner drift. As shown in FIG. 5B, the toner grains deposit on the drum 1 at the position A because of the reduced toner drift. Subsequently, as shown in FIG. 5C, toner grains present on the drum 1 are prevented from again depositing on the carrier grains because the carrier grains are not exposed to the outside. This successfully reduces the omission of a trailing edge.

The nip width can be effectively reduced if the half width of the magnetic pole 2*b* is reduced. It is to be noted that the half width refers to the angular width over which the magnetic force of the main pole is one half of the maximum or peak magnetic force of the magnetic force distribution curve in the normal direction. For example, if the maximum magnetic force of the magnetic pole 2*b*, which is an N pole, is 120 mT, then the half width refers to an angular width over which the magnetic force is 60 mT.

However, experiments showed that reducing the half width of the magnetic pole 2*b* could not fully obviate the omission of a trailing edge alone. This is presumably because the nip cannot be easily reduced at all positions in the axial direction of the sleeve 2*a*. More specifically, the height of the magnet brush 3 is irregular in the axial direction of the sleeve 2*a*, as stated earlier with reference to FIGS. 3A and 3B. If the magnet brush is higher at a certain portion than at the other portions in the axial direction of the sleeve 2*a*, then the nip is not reduced at such a portion, resulting in toner drift. In light of this, a developing device configured to make the magnet brush 3 dense at the nip in order to further reduce the omission of a trailing edge has been proposed, as stated earlier. Why the dense magnet brush 3 is free from irregular height in the axial direction of the sleeve 2*a* will be described with reference to FIGS. 4A through 4D hereinafter.

Figure 4C:
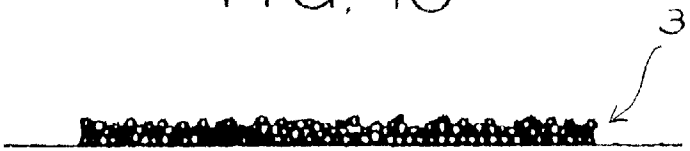
Figure 4D:
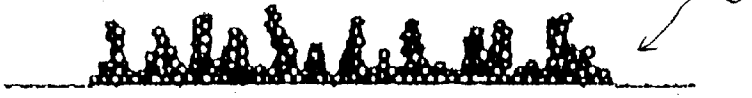

FIG. 4C shows the magnet brush 3 that is dense while FIG. 4D shows a conventional magnet brush. As shown in FIG. 4C, the dense magnet brush 3 has a minimum of irregularity in height in the axial direction of the sleeve 2*a*. FIG. 4A shows a solid image free from the omission of a trailing edge and formed by the dense magnet brush 3. By contrast, as shown in FIG. 4D, the conventional magnet brush is noticeably irregular in height in the above direction. FIG. 4B shows a solid image lost its trailing edge and formed by the conventional magnet brush.

As stated above, if the magnet brush 3 is sufficiently dense and therefore regulated in height before it reaches the nip, it enters the nip in a sufficiently uniform condition in the axial direction of the sleeve 2*a*. As a result, toner drift and therefore the omission of a trailing edge can be sufficiently reduced at all positions in the above direction.

The magnet brush 3 can be made dense if an attenuation ratio at which the flux density of the magnetic pole 2*b* forming the magnet brush 3 attenuates in the normal direction is increased. Assume that the above flux density in the normal direction measured on the surface of the sleeve 2*a* is x, and that the flux density in the same direction measured at a distance of 1 mm from the above surface is y. Then, the attenuation ratio is expressed as:

$$\frac{(x-y)}{x} \times 100\ (\%)$$

For example, if the flux density on the surface of the sleeve 2*a* is 100 mT and if the flux density at the distance of 1 mm is 80 mT, then the attenuation ratio is 20%. To measure the flux density in the normal direction, use may be made of a gauss meter HGM-8300 and an axial probe Type A1 available from ADS. When the attenuation ratio was 40% or above, more preferably 50% or above, the magnet brush 3 was dense enough to sufficiently reduce irregularity in height in the axial direction of the sleeve 2*a*, as determined by experiments.

Why a high attenuation ratio makes the magnet brush 3 dense is presumably accounted for by the following. A high attenuation ratio sharply weakens the magnetic force as the distance from the sleeve surface increases. As a result, the magnetic force at the tip 3*a* of the magnet brush 3 becomes too weak to maintain the magnet brush 3. This causes the sleeve surface, which exerts a strong magnetic force, to attract the carrier grains present on the tip 3*a*.

To increase the attenuation ratio, the magnet 2*a* forming the magnetic pole for development may be formed of an adequate material. Alternatively, the magnetic lines of force extending out from the above magnetic pole may be caused to more intensely turn round. For this purpose, auxiliary magnetic poles opposite in polarity to the above main magnetic pole may be respectively positioned upstream and downstream of the main pole in the direction of movement of the sleeve 2*a*. For the same purpose, the half width of the main pole may be reduced relative to the other poles, which include poles for conveyance, so that most magnetic lines of force issuing from the main pole turn round to the other poles.

A preferred embodiment of the image forming apparatus in accordance with the present invention will be described hereinafter. The embodiment to be described is directed mainly toward the first object stated earlier. First, reference will be made to FIG. 6 for describing why the developer drops or scatters at the downstream auxiliary pole. As shown, the developer risen at the main pole falls down and again rises as it approaches the downstream auxiliary pole. The point where the developer again rises is substantially coincident with a half-value point at the downstream side, as determined by experiments. At this instant, a centrifugal force acts on the developer, or magnet brush, because the magnet brush is forced to change its direction of movement. When the centrifugal force overcomes the magnetic force, the developer scatters. As a result, part of the developer failed to enter a developer storing member, which will be described later, drops.

Figure 6:
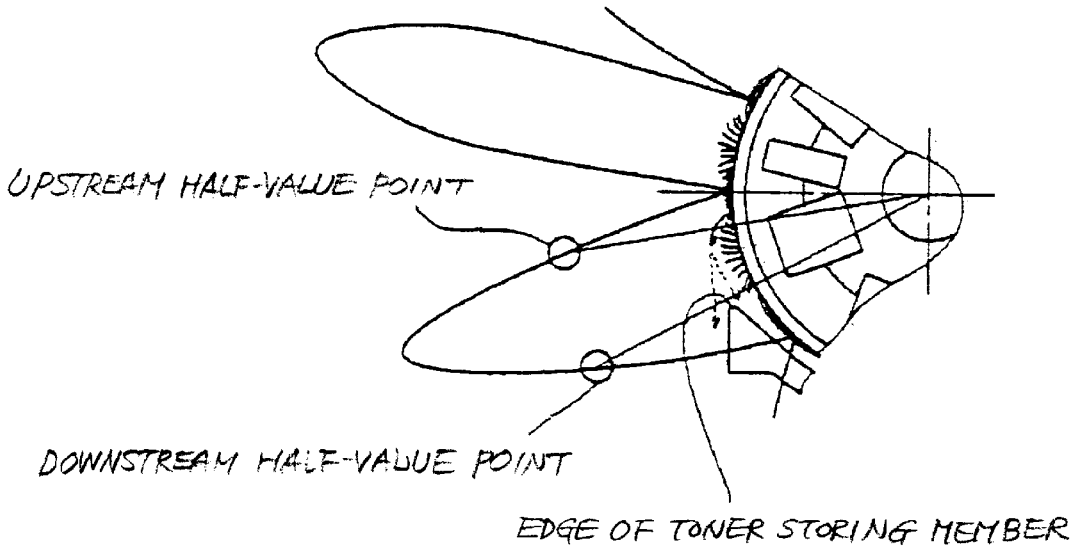
FIG. 6 demonstrates the drop of a developer ascribable to an auxiliary magnetic pole downstream of a main magnetic pole.
Figure 7:
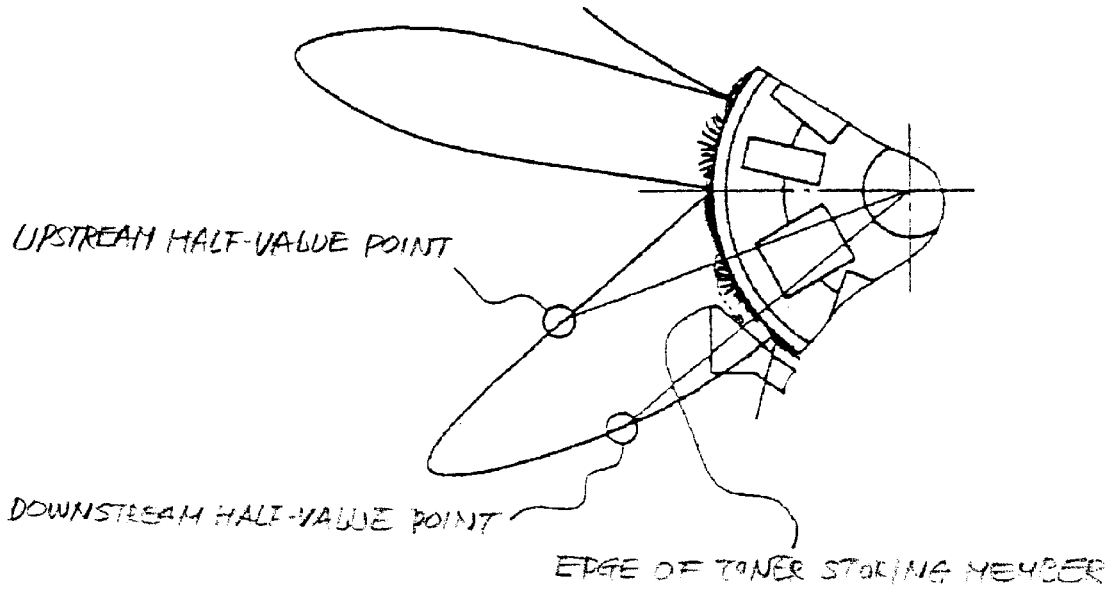
FIG. 7 shows how an embodiment of the present invention prevents the developer from dropping.
Figure 8:
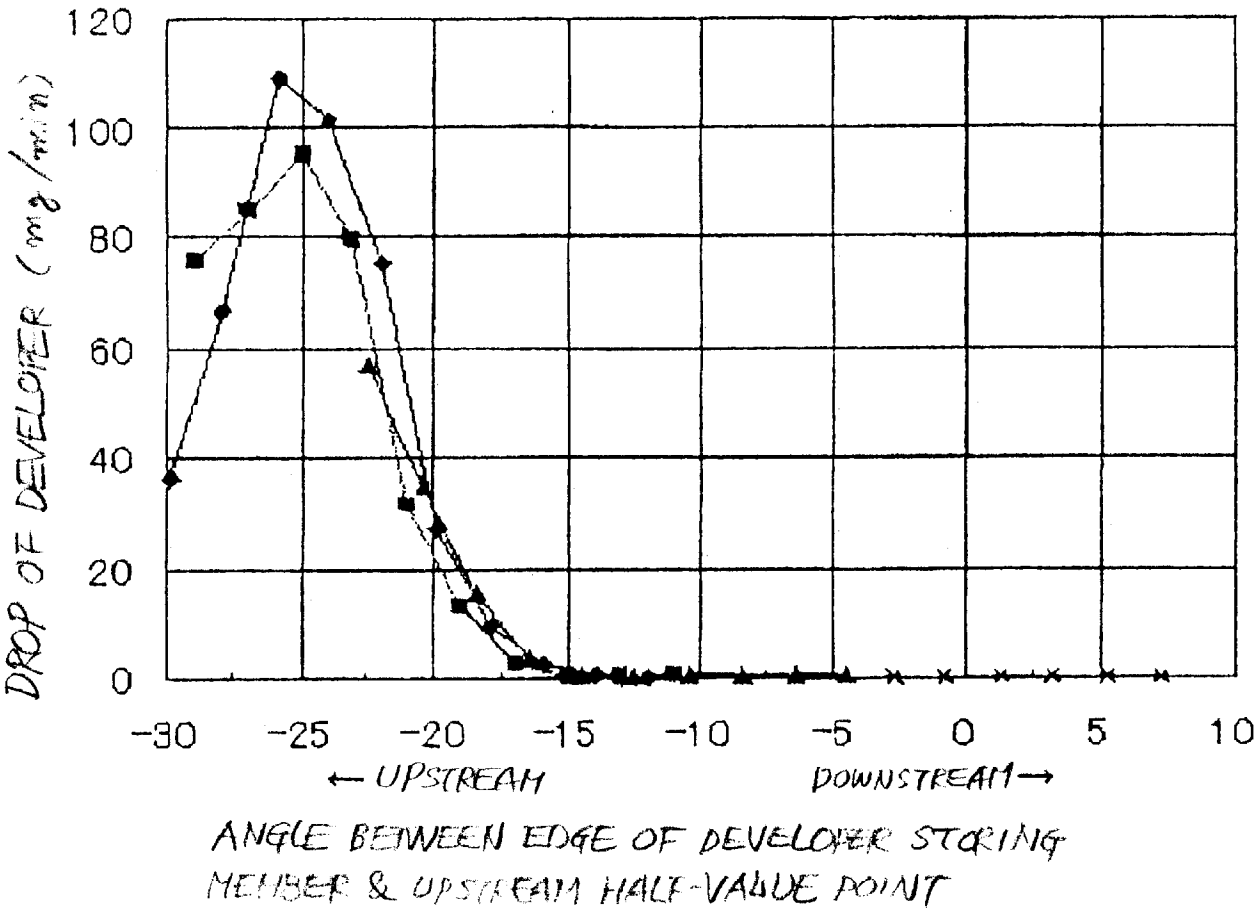
FIG. 8 is a graph showing a relation between an angle between the edge of a developer storing member and the upstream half-value point of the downstream auxiliary pole and the amount of the developer to drop.

As shown in FIG. 7, assume that the downstream half-value point of the downstream auxiliary pole is positioned more downward than in FIG. 6. Then, experiments showed that the developer successfully entered the developer storing member after scattering due to the centrifugal force. FIG. 8 shows experimental results showing a relation between the angle between the upstream half-value point and the edge of the developer storing portion and the amount of the developer to drop. As FIG. 8 indicates, the developer begins to drop when the above angle exceeds about 15° at the upstream side.

However, extended researches and experiments showed that the developer dropped even in the above condition expected to obviate the drop of the developer. The drop was dependent on a relation between a gap Gd between the developer carrier and a metering member and a gap Gc between the developer carrier and the edge of the developer storing member. The metering member regulates the thickness of the developer forming a layer on the developer carrier. This was accounted for by the fact that when the downstream auxiliary pole caused the developer to rise above the gap Gc, the developer was kicked. In the illustrative embodiment, the developer rises at the downstream auxiliary pole to a height about two times as great as the thickness determined by the gap Gd. More specifically, the developer was prevented from dropping when a relation of $Gc \geqq Gd \times 2$ held.

Figure 9:
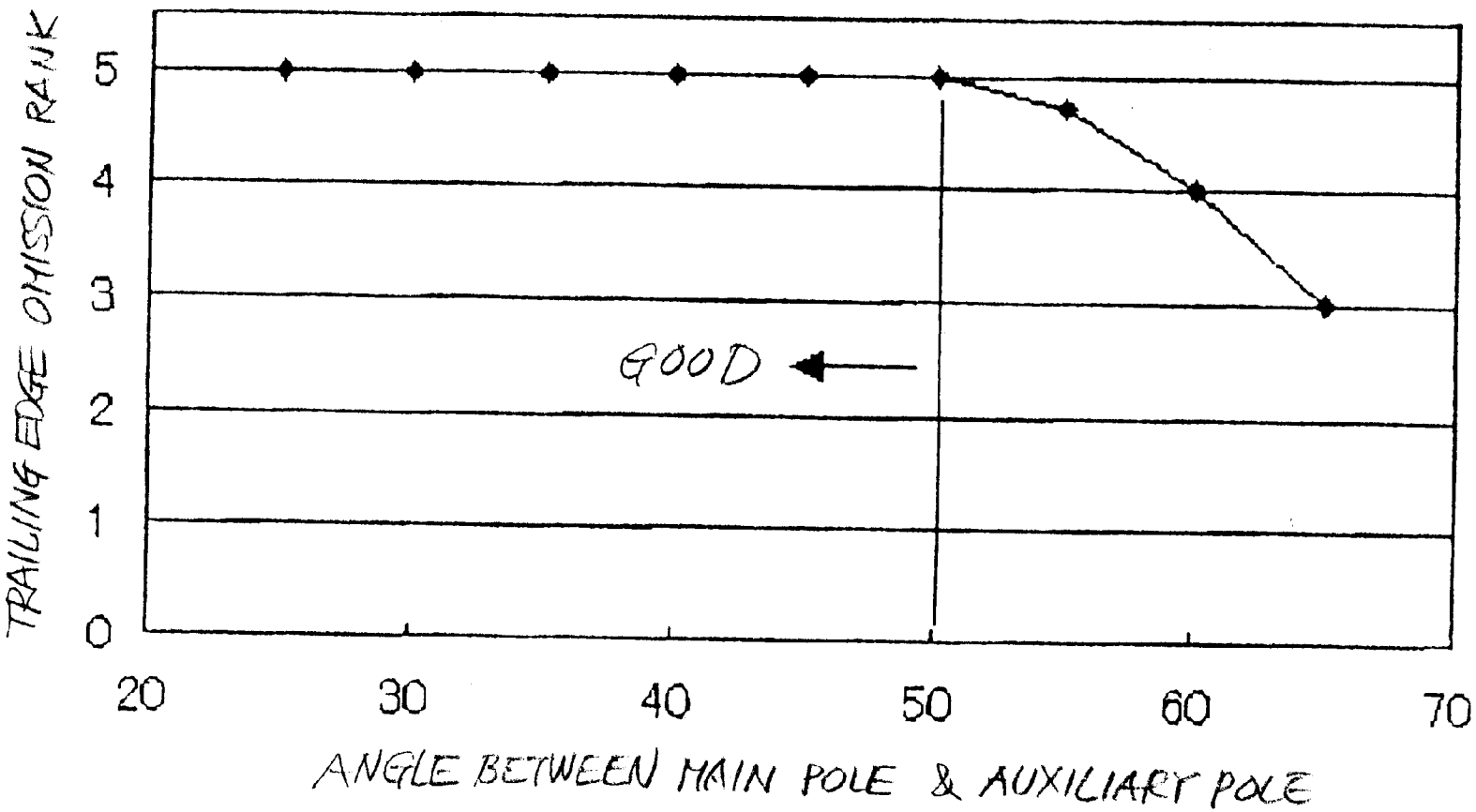
FIG. 9 is a graph showing a relation between the angle between the main pole and the auxiliary pole and the trailing edge omission rank.

The downstream auxiliary pole causes the magnetic lines of force issuing from the main pole to more intensely turn round, as stated previously. The downstream auxiliary pole might therefore again aggravate the omission of a trailing edge if excessively remote from the main pole. FIG. 9 shows the results of experiments conducted to determine a range implementing desirable images. As shown, desirable images free from the omission of a trailing edge are achievable when the angle between the main pole and the downstream auxiliary pole is 50° or below.

Figure 10:
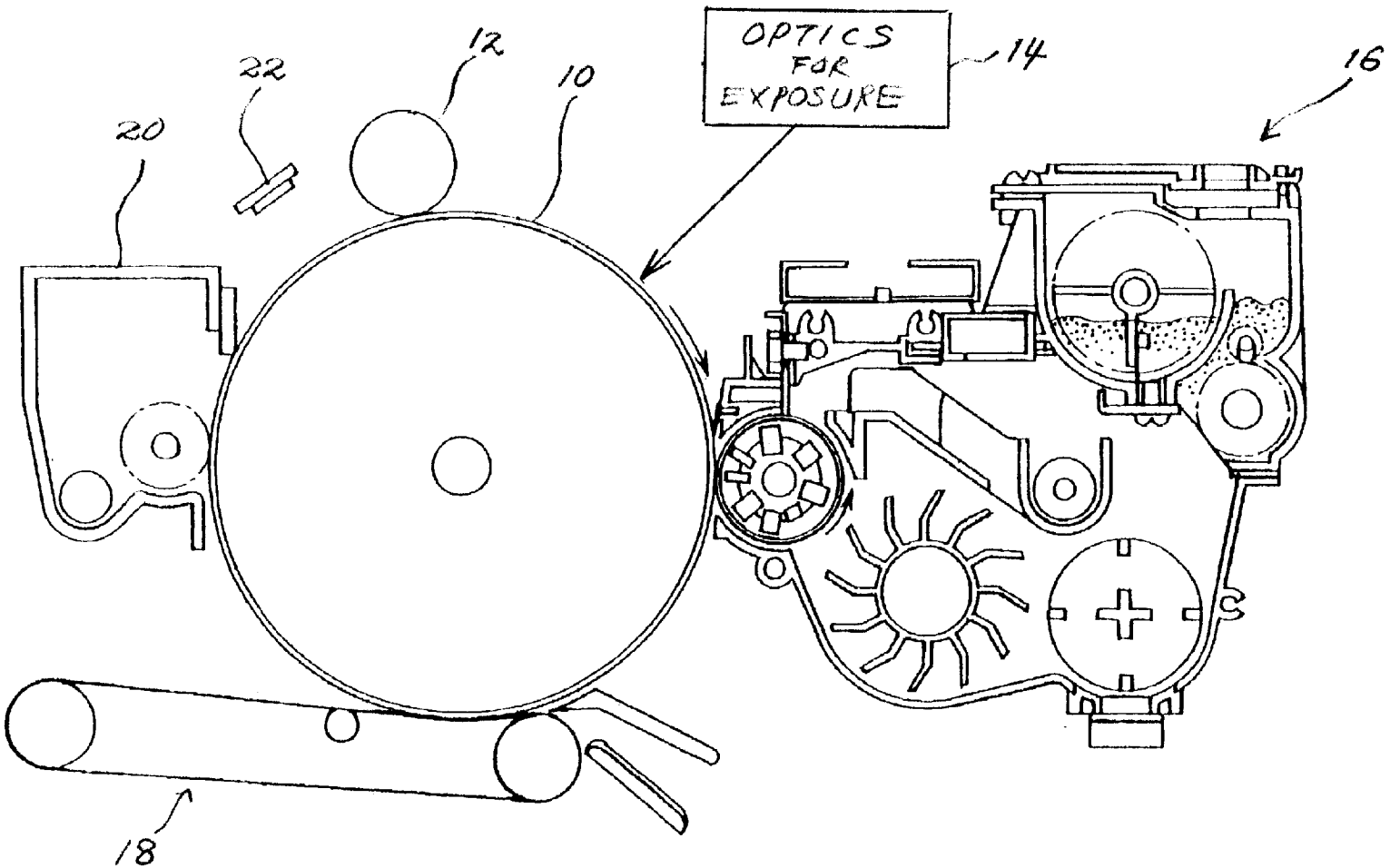
FIG. 10 is a view showing an image forming apparatus embodying the present invention.

The illustrative embodiment will be described with reference to FIG. 10. As shown, the image forming apparatus includes a photoconductive drum or image carrier 10. Arranged around the drum 10 are a charger 12, optics 14 for exposure, a developing device 16, an image transferring device 18, a drum cleaner 20, and a quenching lamp or discharger 22. The charger 12 uniformly charges the surface of the drum 10. The optics 14 scans the charged surface of the drum 10 with, e.g., a laser beam in accordance with image data to thereby form a latent image. The developing device 16 develops the latent image with toner for thereby forming a toner image. The image transferring device 18 transfers the toner image from the drum 10 to a sheet or recording medium with an image transfer roller, a charger or the like. The sheet is fed from a sheet tray not shown. The drum cleaner 20 removes the toner left on the drum 10 after the image transfer. The quenching lamp 22 discharges the surface of the drum 10 cleaned by the drum cleaner 20, thereby preparing the drum 10 for the next image forming cycle. A fixing unit, not shown, fixes the toner image on the sheet.

Figure 11:
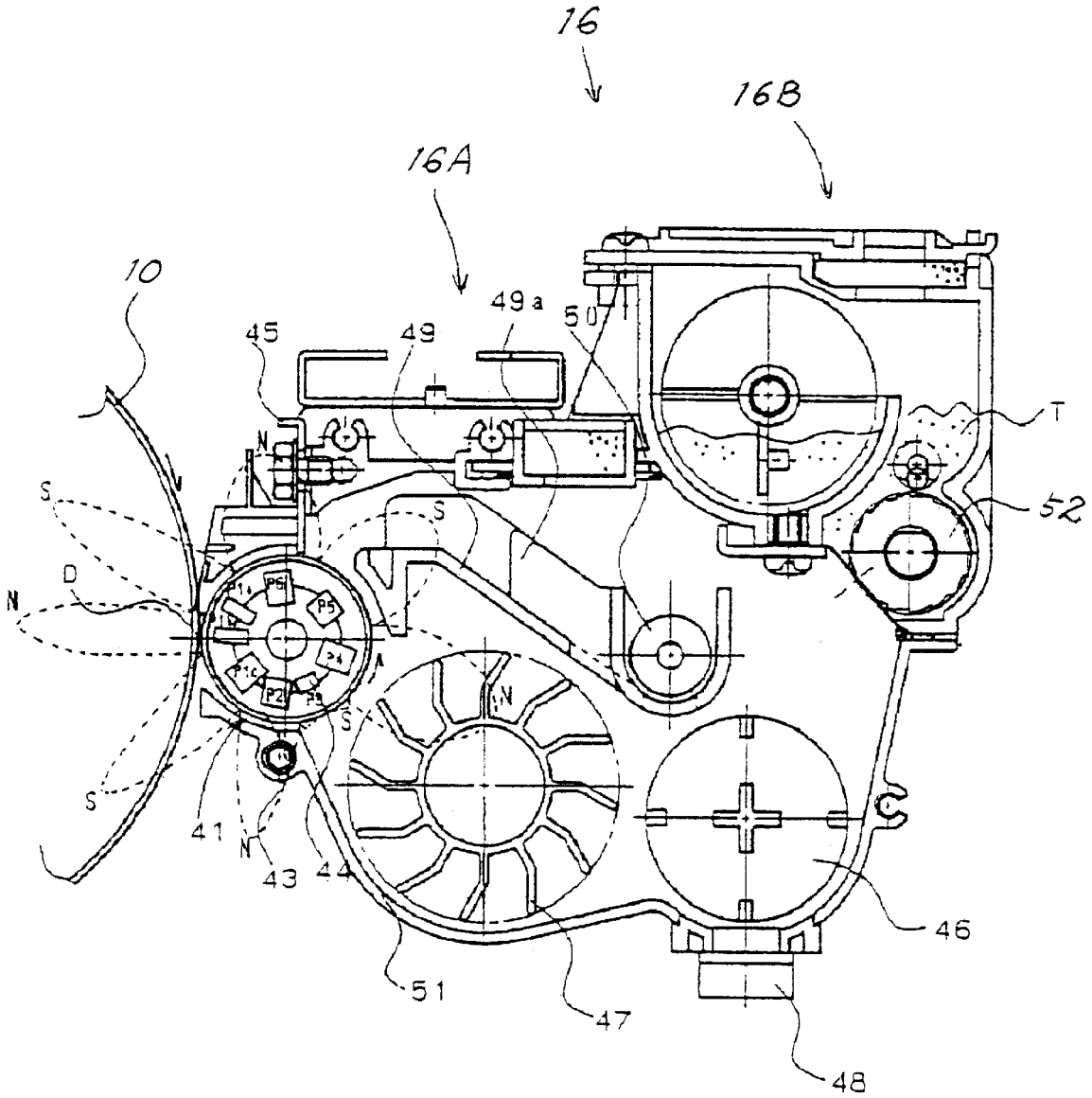
FIG. 11 is a view showing a developing device included in the apparatus of FIG. 10.

FIG. 11 shows a specific configuration of the developing device 16. As shown, the developing device 16 includes a developer container 16A and a toner replenishing section 16B. A developing roller 41 is disposed in the developer container 16A and faces the drum 10. A developing zone D is formed between the developing roller 41 and the drum 10.

The developing roller 41 is made up of a sleeve 43 and a magnet roller 44 fixed in place in the sleeve 43. The sleeve 43 is formed of aluminum, brass, stainless steel, conductive resin or similar nonmagnetic material. A drive mechanism, not shown, causes the sleeve 43 to rotate counterclockwise, as indicated by an arrow in FIG. 11. The magnet roller 44 causes carrier grains, which form part of a developer, to rise on the sleeve 43 along the magnetic lines of force thereof in the form of brush chains. Charged toner grains, which form the other part of the developer, deposit on the brush chains to thereby form a magnet brush. The sleeve 43 conveys the magnet brush counterclockwise, i.e., in the direction in which the sleeve 43 rotates.

A doctor blade or metering member 45 is positioned upstream of the developing zone D in the direction in which the sleeve 43 conveys the developer. The doctor blade 45 regulates the height of the brush chains, i.e., the amount of the developer to reach the developing zone D. An agitator 46 implemented as a roller and a paddle wheel 47 are positioned behind the developing roller 41. While the agitator 46 agitates the developer, the paddle wheel 47 scoops up the developer to the developing roller 41. A casing or developer storing member 51 is positioned below the developing roller 41, paddle wheel 47 and agitator 46 in such a manner as to enclose them.

A toner content sensor 48 is responsive to the toner content of the developer existing in the casing 51. When the toner content of the developer decreases, as determined by the sensor 48, a roller 52 disposed in the toner replenishing section 16B is rotated to replenish fresh toner T toward the agitator 46. A separator 49 extends from a position adjoining the doctor blade 45 to a position above the agitator 46. A screw conveyor 50 is positioned at the end of the separator 49 adjoining the agitator 46.

In operation, the paddle wheel 47 in rotation scoops up the developer to the developing roller 41. The developer deposits on the developing roller 41 due to the magnetic force of the magnet roller 44. The sleeve 43 in rotation conveys the developer while the doctor blade 45 regulates the thickness of the developer forming a layer on the sleeve 43. The developer then sequentially moves through the developing zone D and the gap between the developing roller 41 and the casing 51. Subsequently, at a position where the magnetic force of the magnet roller 44 does not act, the developer drops to the bottom of the casing 51, as will be described more specifically later. The paddle wheel 47 again agitates the developer dropped to the bottom of the casing 51.

The developer scraped off by the doctor blade 45 is delivered toward the rear of the apparatus by fins 49*a*, which are mounted on the top of the separator 49. The rear end of the separator 49 terminates at a guide groove in which the screw conveyor 50 is positioned. The screw conveyor 50 conveys the developer toward the front of the apparatus. The developer then drops to the agitator 46 via a slit, not shown, facing the agitator 46. While the developer is so conveyed toward the rear and then toward the front of the apparatus, it is agitated to have a uniform toner content in the front-and-rear direction. Also, the developer is conveyed rearward and then forward in the same amount and maintained at a preselected level thereby.

The magnet roller 44 has a plurality of magnetic poles. Specifically, a main pole P1*b* for development causes the developer to rise in the developing zone D in the form of a magnet brush. Auxiliary poles P1*a* and P1*c* are positioned at opposite sides of the main pole P1*b* and opposite in polarity to the main pole P1*b*. A pole P4 scoops up the developer to the sleeve 43. Poles P5 and P6 convey the developer deposited on the sleeve 43 to the developing zone D. Poles P2 and P3 convey the developer at positions downstream of the developing zone D. The poles P1*a* through P6 all are oriented in the radial direction of the sleeve 43. While the magnet roller 44 is shown as having eight poles or magnets, it may have additional poles between the pole P3 and the doctor blade 45 in order to enhance scoop-up and the ability to follow a black, solid image, e.g., ten poles or twelve poles in total.

Figure 12:
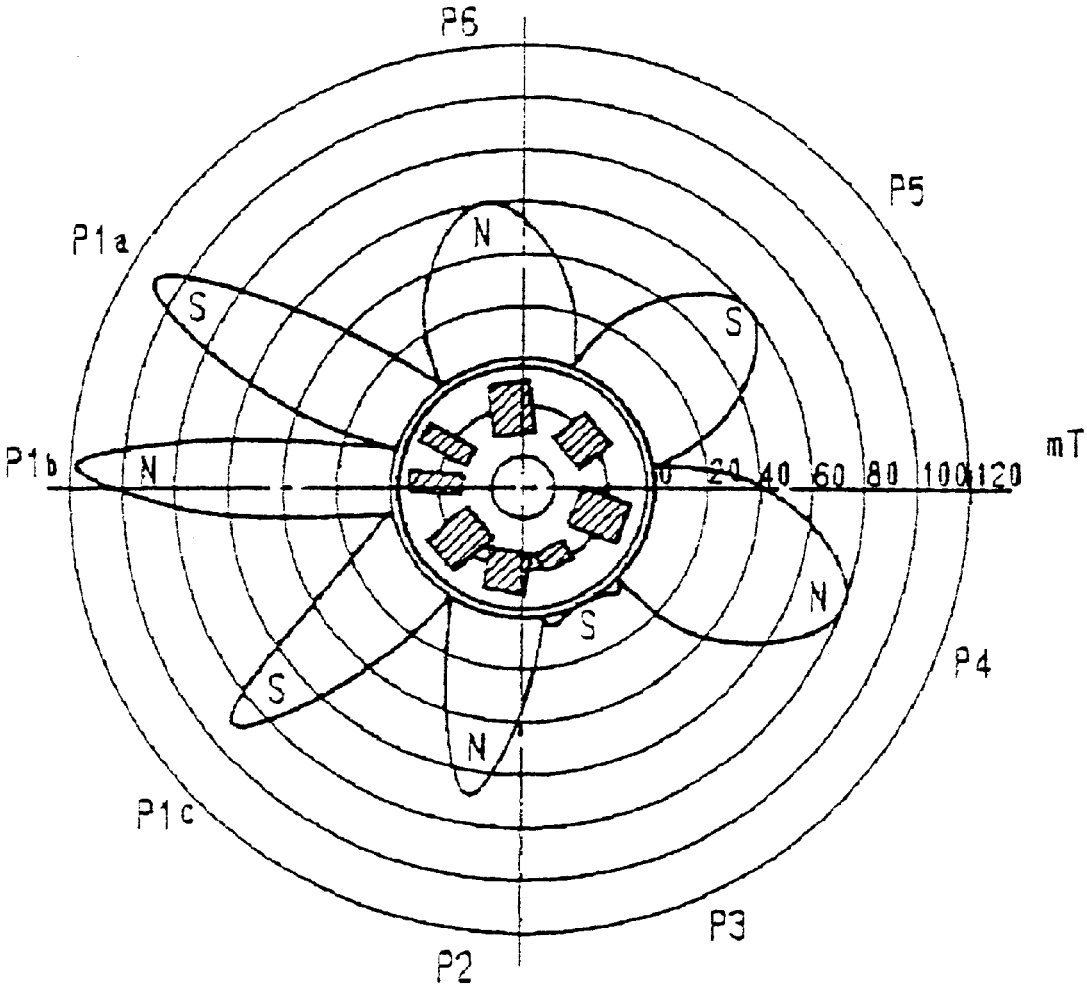
FIG. 12 is a chart showing the flux densities of magnetic poles of a magnet roller included in the developing device.

As shown in FIG. 12, in the illustrative embodiment, the poles P1*a*, P1*b* and P1*c* are implemented by magnets having a small cross-sectional area each. Generally, a magnetic force decreases with a decrease in the cross-sectional area of a magnet. If the magnetic force on the sleeve surface is excessively weak, then it is likely that the force retaining the carrier grains is too weak to prevent the carrier grains from depositing on the drum 1. In light of this, in the illustrative embodiment, the magnets forming the poles P1*a*, P1*b* and P1*c* each are formed of a rare earth metal alloy that exerts a strong magnetic force. Typical of magnets formed of rare earth metal alloys are an iron-neodium-boron alloy magnet having the maximum energy product of 358 $kJ/m^3$ and an iron-neodium-boron alloy bond magnet having the maximum energy product of about 80 $kJ/m^3$. Such maximum energy products each are greater than, e.g., the maximum energy product of about 36 $kJ/m^3$ available with a conventional ferrite magnet or the maximum energy product of about 20 $kJ/m^3$ available with a conventional ferrite bond magnet. Consequently, even the magnets having a small cross-sectional area can insure the expected magnetic forces on the sleeve surface. A samarium-cobalt metal alloy magnet is another magnet that can insure the above magnetic force. For the other poles P2 through P6, use may be made of ferrite magnets or ferrite bond magnets as conventional.

In the above configuration, the main pole P1*b* has its half width reduces and therefore reduces the nip width. This causes a minimum of toner drift to occur and thereby reduces the omission of a trailing edge.

Moreover, the auxiliary poles P1*a* and P1*c* intensify the turn-round of the magnetic lines of force issuing from the main pole P1*b*, thereby increasing the attenuation ratio of the flux density at the nip in the normal direction. The resulting dense magnet brush is uniform at the nip in the axial direction of the sleeve, reducing the omission of a trailing edge over the entire axial range of the sleeve.

Figure 13:
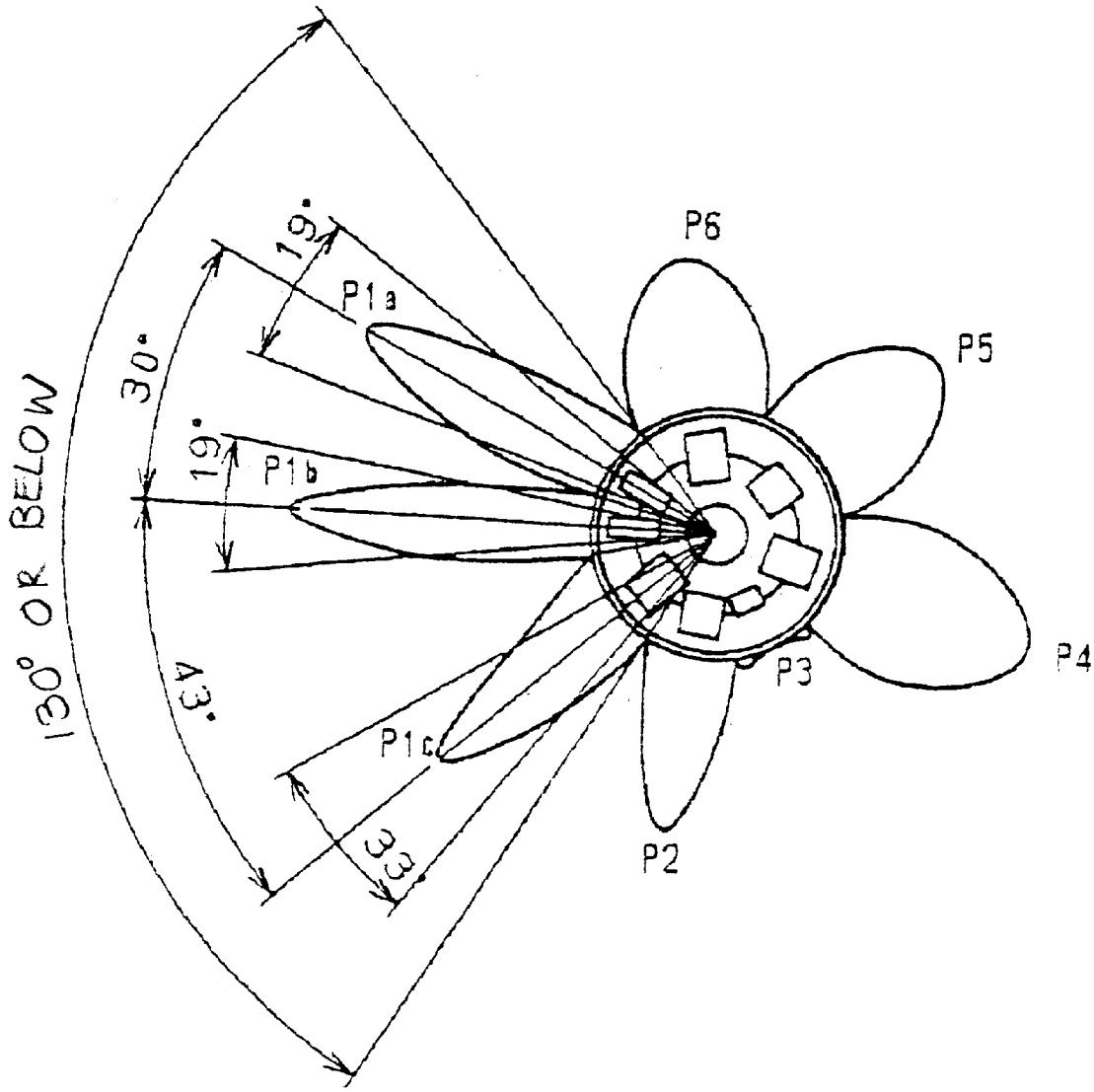
FIG. 13 shows an angle between a main magnetic pole and auxiliary magnetic poles included in the magnet roller.

More specifically, experiments were conducted under the following conditions. The drum 10 and sleeve 43 had diameters of 100 mm and 25 mm, respectively. As shown in FIG. 13, the angle between the auxiliary pole P1*a* upstream of the main pole P1*b* and the main pole P1*b* was selected to be 35° or below. The angle between the other auxiliary pole P1*c* downstream of the main pole P1*b* and the main pole P1*b* was selected to be 50° or below. The experiments showed that the main pole P1*b* had a half width of 22° or below. FIG. 13 shows a specific condition in which the above angles of the auxiliary poles P1*a* and P1*c* were 30° and 43°, respectively; the half width of the main pole P1*b* was 19°.

Further, assume a transition point where polarity changes from the N pole to the S pole or vice versa. Then, the angle between the transition point between the auxiliary pole P1*a* and the pole P6 and the transition point between the auxiliary pole P1*c* and the pole P2 was selected to be 130° or below. The drum 10 and sleeve 700 were caused to move at linear velocities of 350 mm/sec and 700 mm/sec, respectively. In these conditions, the nip width was as small as 2 mm or less. The main pole P1*b* had flux density that was 119 mT on the sleeve surface and was 55.5 mT at a distance of 1 mm from the sleeve surface; the attenuation ratio was 53.4%.

Even when upstream auxiliary pole P1*a* was omitted, the downstream auxiliary pole P1*c* also sufficiently served to intensity the turn-round of the magnetic lines of force issuing from the main pole P1*b* only if the angle between the poles P1*b* and P1*c* was 50°, more specifically 43°. In this condition, a dense magnet brush was formed if the attenuation ratio of the flux density at the nip was 40% or above, sufficiently reducing the omission of a trailing edge.

Figure 14:
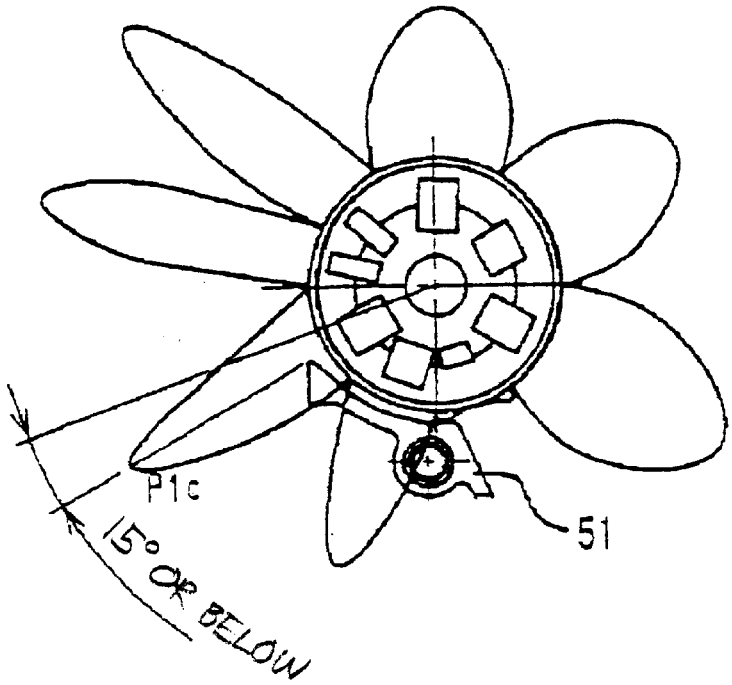
FIG. 14 shows a specific configuration of the illustrative embodiment.

As shown in FIG. 14, in the illustrative embodiment, the upstream half-value point of the auxiliary pole P1*c* is positioned within the angle of 15°, more specifically 10°, from the edge of the casing 51. Even when the developing device 16 is operated at high speed, the above half-value point allows the developer scattered at the pole P1*c* due to the previously stated centrifugal force to enter the casing 51 without dropping.

Figure 15:
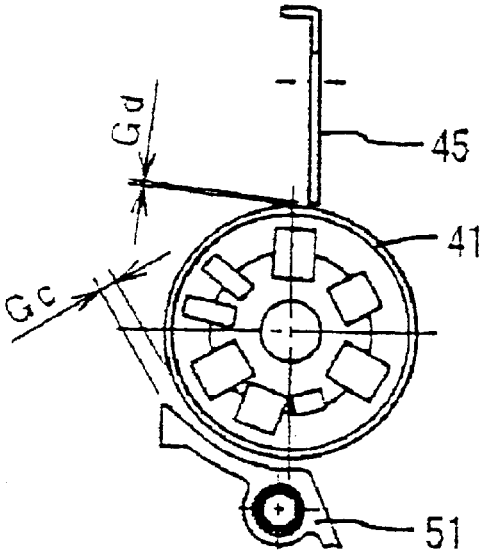
FIG. 15 shows another specific configuration of the illustrative embodiment.

As shown in FIG. 15, the gaps Gc and Gd, which have the previously stated relation of $Gd \geqq Gd \times 2$, may be 1.1 mm and 0.4 mm, respectively. This prevents the developer from rising above the gap Gc at the pole P1*c* and dropping.

Hereinafter will be described an alternative embodiment of the present invention directed mainly toward the second object stated previously. In the illustrative embodiment, experiments were conducted under the following conditions. The drum 10 and sleeve 43 had diameters of 100 mm and 25 mm, respectively. Again, as shown in FIG. 13, the angle between the auxiliary pole P1*a* upstream of the main pole P1*b* and the main pole P1*b* was selected to be 35° or below, more specifically 30°. The angle between the other auxiliary pole P1*c* downstream of the main pole P1*b* and the main pole P1*b* was selected to be 50° or below, more specifically 43°. The experiments showed that the main pole P1*b* had a half width of 22° or below, more specifically 19°, while the auxiliary pole 1*c* had a half width of 25° or above, more specifically 33°.

Further, the angle between the transition point between the auxiliary pole P1*a* and the pole P6 and the transition point between the auxiliary pole P1*c* and the pole P2 was selected to be 130° or below. The drum 10 and sleeve 43 were caused to move at linear velocities of 35° mm/sec and 700 mm/sec, respectively. In these conditions, the nip width was as small as 2 mm or less.

Figure 16:
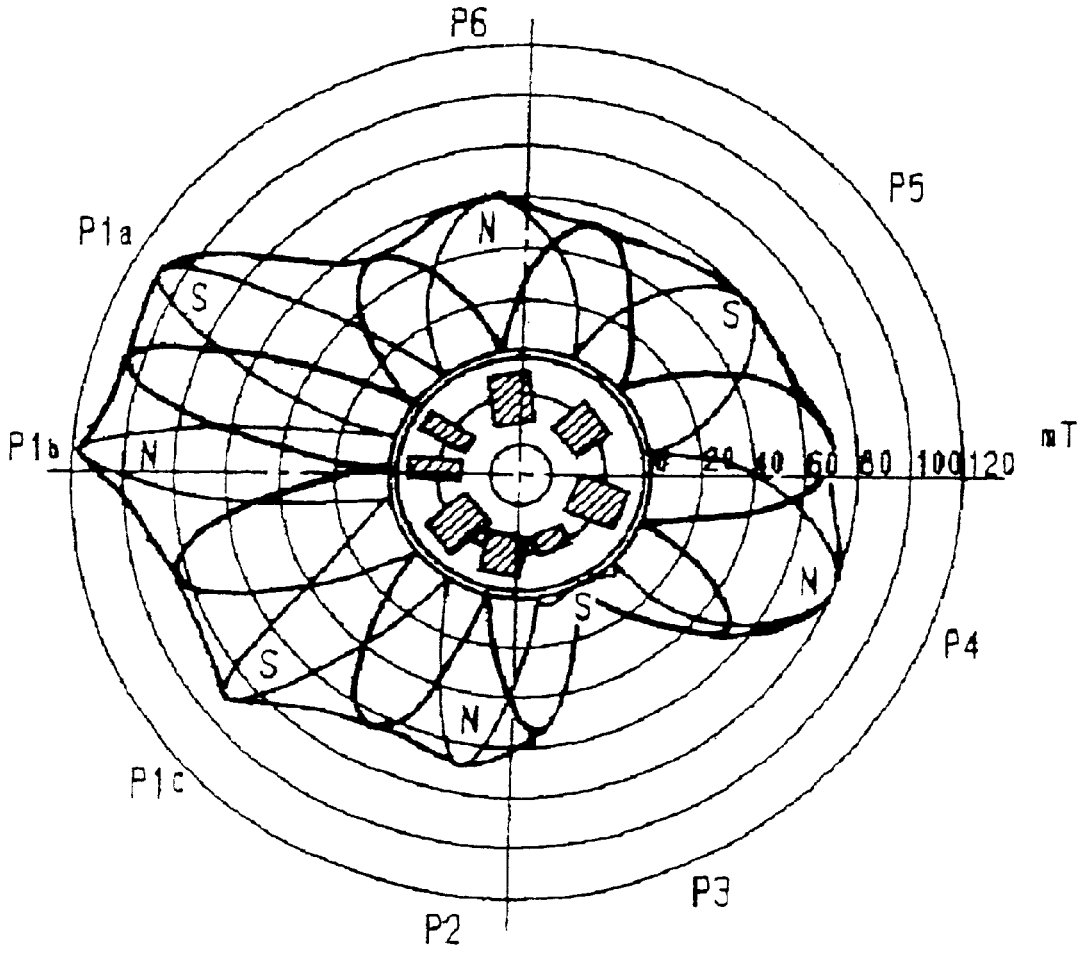
FIG. 16 is a chart showing flux densities in the normal direction and tangential direction and the sum of their vectors.

Moreover, as shown in FIG. 16, the sum of vectors of the flux density in the normal direction and tangential direction was as great as 95 mT even at the lowest position between the main pole P1*b* and the downstream auxiliary pole P1*c*. In this case, the carrier grains had a volume mean grain size of 55 $\mu$m and saturation magnetization ratio of 65 emu/g. When the flux density at each pole was varied to vary the sum of the above vectors, i.e., composite flux density, noticeable carrier deposition did not occur if the sum was 85 mT or above. It was also found that the smaller the carrier grain size, the greater the composite flux density necessary for the prevention of carrier deposition.

In the illustrative embodiment, the main pole or first pole P1*b* has flux density whose attenuation ratio in the normal direction is 40% or above. This, coupled with the vector sum of 85 mT or above, reduces the omission of a trailing edge and other defects. At the same time, even when the carrier grains have a small grain size, there can be obviated carrier deposition that brings about the problems discussed earlier. Furthermore, the auxiliary pole or second pole P1*c* has the flux density of 80 mT or above in the normal direction and having the attenuation ratio of 35% or below. This guarantees a sufficient magnetic attracting force even at a position spaced from the surface of the sleeve or developer carrier.

Various modifications will become possible for those skilled in the art after receiving the teachings of the present disclosure without departing from the scope thereof.

What is claimed is:

1. A developing device comprising:

a developer carrier;

magnet brush forming means for causing a developer to rise on said developer carrier in a form of a magnet brush with a magnetic pole; and a developer storing member for storing the developer developed a latent image;

wherein said magnet brush forming means comprises at least a first magnetic pole facing an image carrier carrying the latent image, which is to be developed by the magnet brush, and a second magnetic pole positioned downstream of said first magnetic pole in a direction of rotation of said developer carrier, and when the magnet brush formed by said first magnetic pole forms a nip between said magnet brush and the image carrier, a flux density in a direction normal to said developer carrier has an attenuation ratio of 40% or above while said second magnetic pole has an upstream half-value point located downstream of a point upstream of and angularly spaced from an edge of said developer storing member by 15°.

2. The device as claimed in claim 1, wherein said first magnetic pole and said second magnetic pole make an angle of 50° or below therebetween with respect to a center between half values.

3. A developing device comprising:

a developer carrier;

magnet brush forming means for causing a developer to rise on said developer carrier in a form of a magnet brush with a magnetic pole; and a developer storing member for storing the developer developed a latent image;

wherein said magnet brush forming means comprises at least a first magnetic pole facing an image carrier carrying the latent image, which is to be developed by the magnet brush, and a second magnetic pole positioned downstream of said first magnetic pole in a direction of rotation of said developer carrier, and when the magnet brush formed by said first magnetic pole forms a nip between said magnet brush and the image carrier, a flux density in a direction normal to said developer carrier has an attenuation ratio of 40% or above, and there holds a relation:

$$Gc \geqq Gd \times 2$$

where Gd denotes a gap between said metering member and said developer carrier, and Gc denotes a gap between said developer storing member and said developer carrier.

4. The apparatus as claimed in claim 3, wherein said first magnetic pole and said second magnetic pole make an angle of 50° or below therebetween with respect to a center between half values.

5. A developing device comprising:

a developer carrier;

magnet brush forming means for causing a developer to rise on said developer carrier in a form of a magnet brush with a magnetic pole;

an image carrier on which a latent image to be developed by the developer risen on said developer carrier; and a developer storing member for storing the developer developed the latent image;

wherein said magnet brush forming means comprises at least a first magnetic pole facing said image carrier and a second magnetic pole positioned downstream of said first magnetic pole in a direction of rotation of said image carrier, and when the magnet brush formed by said first magnetic pole forms a nip between said magnet brush and said image carrier, a flux density in a direction normal to said developer carrier has an attenuation ratio of 40% or above while said second magnetic pole has an upstream half-value point located downstream of a point upstream of and angularly spaced from an edge of said developer storing member by 15°.

6. A developing device comprising:

a developer carrier;

magnet brush forming means for causing a developer to rise on said developer carrier in a form of a magnet brush with a magnetic pole;

an image carrier on which a latent image to be developed by the developer risen on said developer carrier;

a developer storing member for storing the developer developed the latent image; and a metering member for regulating a thickness of the developer forming a layer on said developer carrier;

wherein said magnet brush forming means comprises at least a first magnetic pole facing said image carrier and a second magnetic pole positioned downstream of said first magnetic pole in a direction of rotation of said image carrier, and when the magnet brush formed by said first magnetic pole forms a nip between said magnet brush and said image carrier, a flux density in a direction normal to said developer carrier has an attenuation ratio of 40% or above, and there holds a relation:

$$Gc \geqq Gd \times 2$$

where Gd denotes a gap between said metering member and said developer carrier, and Gc denotes a gap between said developer storing member and said developer carrier.

7. A developing device comprising:

a developer carrier;

magnet brush forming means for causing a developer to rise on said developer carrier in a form of a magnet brush with a magnetic pole; and a developer storing member for storing the developer developed a latent image;

wherein said magnet brush forming means comprises at least a first magnetic pole facing an image carrier carrying the latent image, which is to be developed by the magnet brush, and a second magnetic pole positioned downstream of said first magnetic pole in a direction of rotation of said developer carrier, a flux density of said first magnetic pole in a direction normal to said developer carrier has an attenuation ratio of 40% or above, and a flux density in a normal direction and a flux density in a tangential direction between said first magnetic pole and said second magnetic pole have vectors a sum of which is 85 mT or above.

8. The device as claimed in claim 7, wherein said second magnetic pole has a flux density of 80 mT or above in the normal direction, as measured on a surface of said developer carrier, and the attenuation ratio is 35% or below.

9. The device as claimed in claim 8, wherein the developer contains a carrier having a volume mean grain size of 65 $\mu$m or below.

10. The device as claimed in claim 9, wherein the carrier has a saturation magnetization ratio of 80 emu/g.

11. The device as claimed in claim 10, wherein said first magnetic pole has a maximum energy product of 50 kJ/m$^3$.

12. The device as claimed in claim 7, wherein the developer contains a carrier having a volume mean grain size of 65 $\mu$m or below.

13. The device as claimed in claim 12, wherein the carrier has a saturation magnetization ratio of 80 emu/g.

14. The device as claimed in claim 13, wherein said first magnetic pole has a maximum energy product of 50 kJ/m$^3$.

15. The device as claimed in claim 7, wherein the carrier has a saturation magnetization ratio of 80 emu/g.

16. The device as claimed in claim 15, wherein said first magnetic pole has a maximum energy product of 50 kJ/m$^3$.

17. The device as claimed in claim 7, wherein said first magnetic pole has a maximum energy product of 50 kJ/m$^3$.

18. An image forming apparatus comprising:

a developer carrier;

magnet brush forming means for causing a developer to rise on said developer carrier in a form of a magnet brush with a magnetic pole; and a developer storing member for storing the developer developed a latent image;

wherein said magnet brush forming means comprises at least a first magnetic pole facing an image carrier carrying the latent image, which is to be developed by the magnet brush, and a second magnetic pole positioned downstream of said first magnetic pole in a direction of rotation of said developer carrier, a flux density of said first magnetic pole in a direction normal to said developer carrier has an attenuation ratio of 40% or above, and a flux density in a normal direction and a flux density in a tangential direction between said first magnetic pole and said second magnetic pole have vectors a sum of which is 85 mT or above.

* * * * *